US011371232B1

(12) United States Patent
Ronan, Sr. et al.

(10) Patent No.: US 11,371,232 B1
(45) Date of Patent: Jun. 28, 2022

(54) MODULAR TOILET FLANGE

(71) Applicants: David Ronan, Sr., Cincinnati, OH (US); Curtis Carpenter, Cincinnati, OH (US)

(72) Inventors: David Ronan, Sr., Cincinnati, OH (US); Curtis Carpenter, Cincinnati, OH (US)

( * ) Notice: Subject to any disclaimer, the term of this patent is extended or adjusted under 35 U.S.C. 154(b) by 0 days.

(21) Appl. No.: 17/209,377

(22) Filed: Mar. 23, 2021

(51) Int. Cl.
*E03D 11/16* (2006.01)

(52) U.S. Cl.
CPC ..... *E03D 11/16* (2013.01)

(58) Field of Classification Search
CPC ..... E03D 11/16; F16B 33/02
See application file for complete search history.

(56) References Cited

U.S. PATENT DOCUMENTS

| | | | | |
|---|---|---|---|---|
| 4,940,113 | A * | 7/1990 | L'Heureux | E03D 11/16 4/DIG. 9 |
| D334,051 | S | 3/1993 | Fell, Sr. | |
| 5,335,849 | A | 8/1994 | Forbes | |
| 5,377,361 | A | 1/1995 | Piskula | |
| 6,115,852 | A | 9/2000 | Munoz-Garcia | |
| 6,155,606 | A | 12/2000 | Phillips | |
| 2003/0053882 | A1 | 3/2003 | Reuter | |
| 2014/0041108 | A1* | 2/2014 | Duncan | E03D 11/16 4/252.6 |
| 2016/0024776 | A1 | 1/2016 | Wood | |
| 2016/0312458 | A1* | 10/2016 | Mehari | E03D 11/16 |

FOREIGN PATENT DOCUMENTS

| | | |
|---|---|---|
| WO | 2012131490 | 10/2012 |

* cited by examiner

*Primary Examiner* — Janie M Loeppke
(74) *Attorney, Agent, or Firm* — Kyle A. Fletcher, Esq.

(57) ABSTRACT

The modular toilet flange may be a fitting that mounts a toilet to a floor and directs effluent from the toilet to an outflow pipe. The modular toilet flange may comprise a flange body and an inner ring. The flange body may couple to the floor and to the outflow pipe. The inner ring may be a circular depression in the flange body surrounding an open center of the flange body. A pair of bolts extending downward through the toilet may couple to the inner ring by engaging the inner ring. During installation, the toilet may be operable to rotate above the flange body to any angle and still engage the inner ring, thus eliminating a need for a specific alignment of the toilet with mounting bolts extending upwards from a flange.

18 Claims, 5 Drawing Sheets

MODULAR TOILET FLANGE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of toilet fittings, more specifically, a modular toilet flange.

SUMMARY OF INVENTION

The modular toilet flange may be a fitting that mounts a toilet to a floor and directs effluent from the toilet to an outflow pipe. The modular toilet flange may comprise a flange body and an inner ring. The flange body may couple to the floor and to the outflow pipe. The inner ring may be a circular depression in the flange body surrounding an open center of the flange body. A pair of bolts extending downward through the toilet may couple to the inner ring by engaging the inner ring. During installation, the toilet may be operable to rotate above the flange body to any angle and still engage the inner ring, thus eliminating a need for a specific alignment of the toilet with mounting bolts extending upwards from a flange.

An object of the invention is to provide a fitting that mounts a toilet to a floor and directs effluent from the toilet to an outflow pipe.

Another object of the invention is to provide a flange body that mounts to the floor and couples to the outflow pipe.

A further object of the invention is to provide an inner ring at the top of the flange body that comprises a threaded inside surface and a threaded outside surface such that an individual bolt may screw into the inner ring at any point around the circumference of the inner ring.

Yet another object of the invention is to couple a toilet to the flange body by placing the toilet over the invention, rotating the toilet to a desired orientation, and screwing a pair of bolts through a pair of bolt apertures in the toilet and into the inner ring.

These together with additional objects, features and advantages of the modular toilet flange will be readily apparent to those of ordinary skill in the art upon reading the following detailed description of the presently preferred, but nonetheless illustrative, embodiments when taken in conjunction with the accompanying drawings.

In this respect, before explaining the current embodiments of the modular toilet flange in detail, it is to be understood that the modular toilet flange is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the modular toilet flange.

It is therefore important that the claims be regarded as including such equivalent construction insofar as they do not depart from the spirit and scope of the modular toilet flange. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
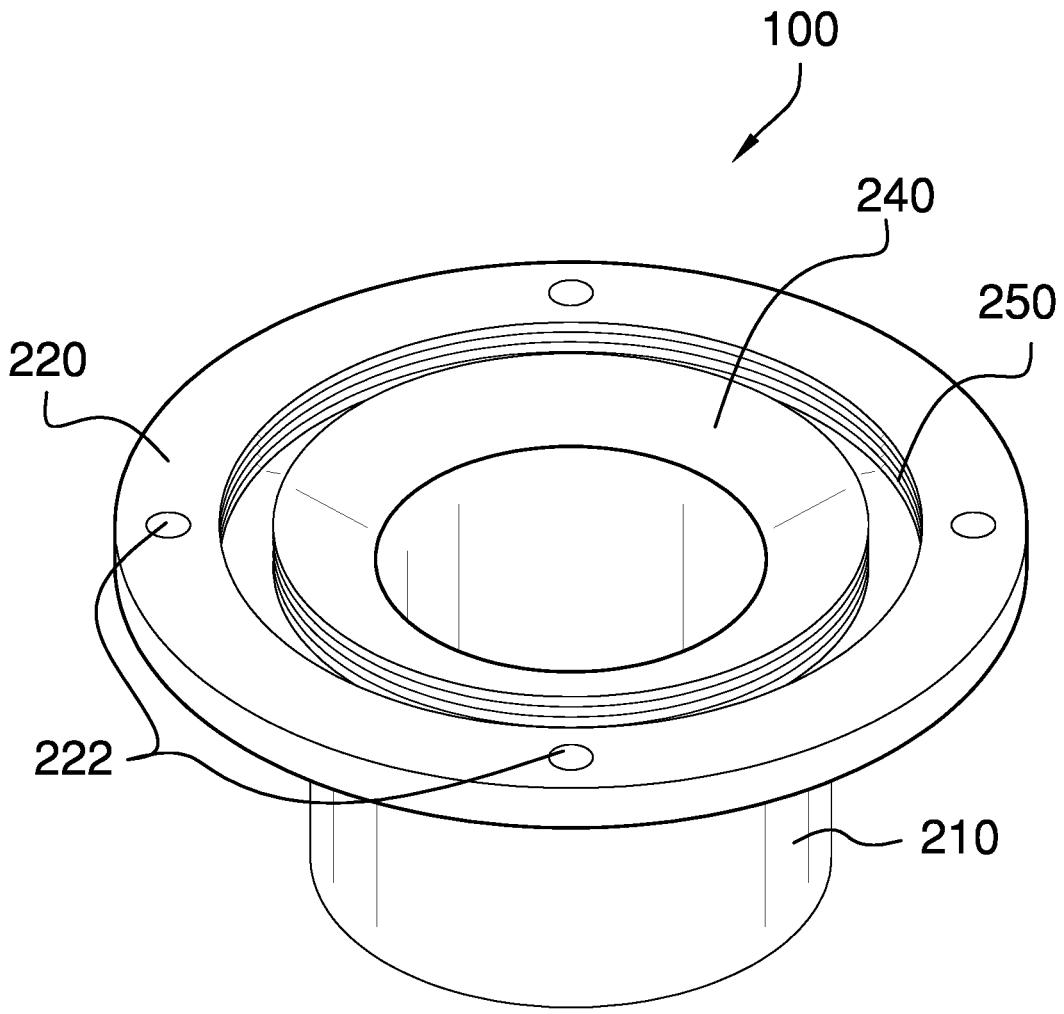
FIG. 1 is an isometric view of an embodiment of the disclosure.
Figure 2:
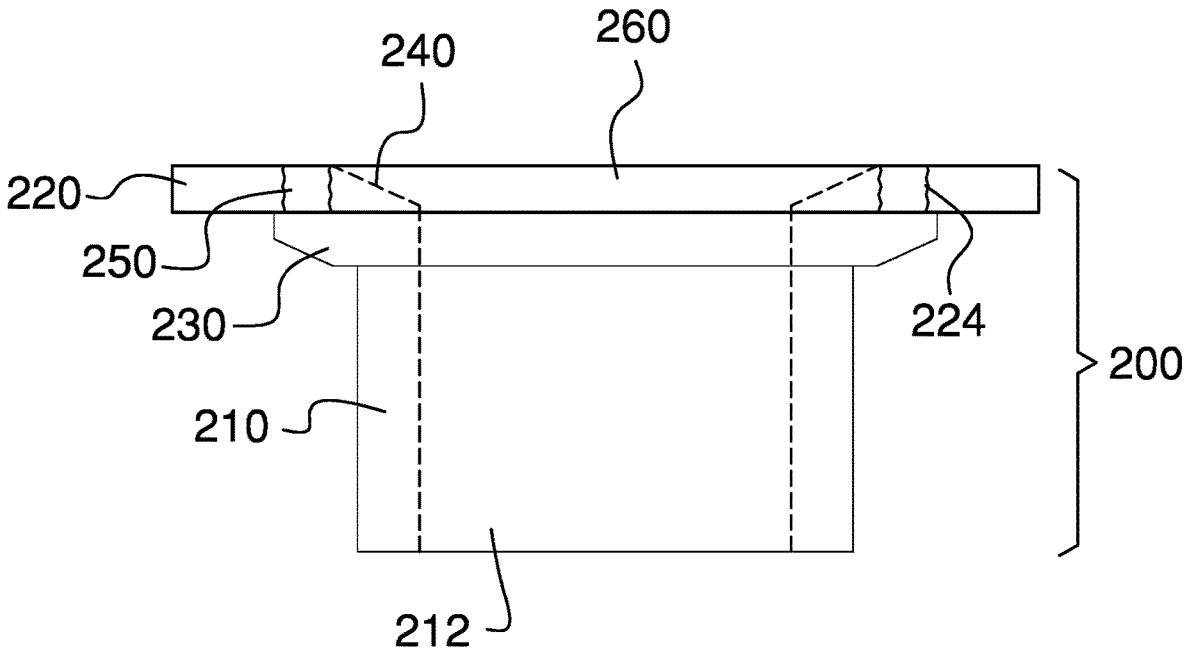
FIG. 2 is a side view of an embodiment of the disclosure.
Figure 3:
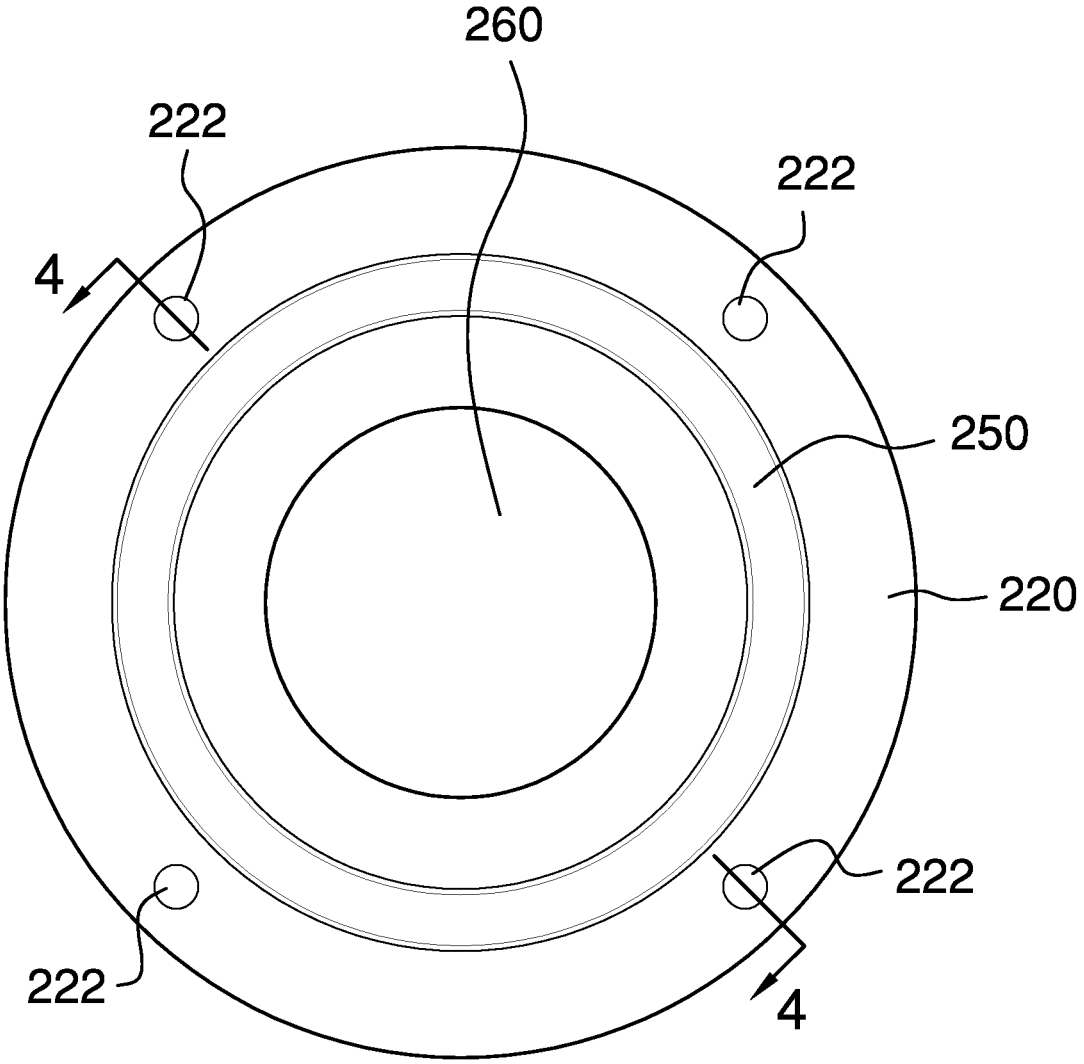
FIG. 3 is a top view of an embodiment of the disclosure.
Figure 4:
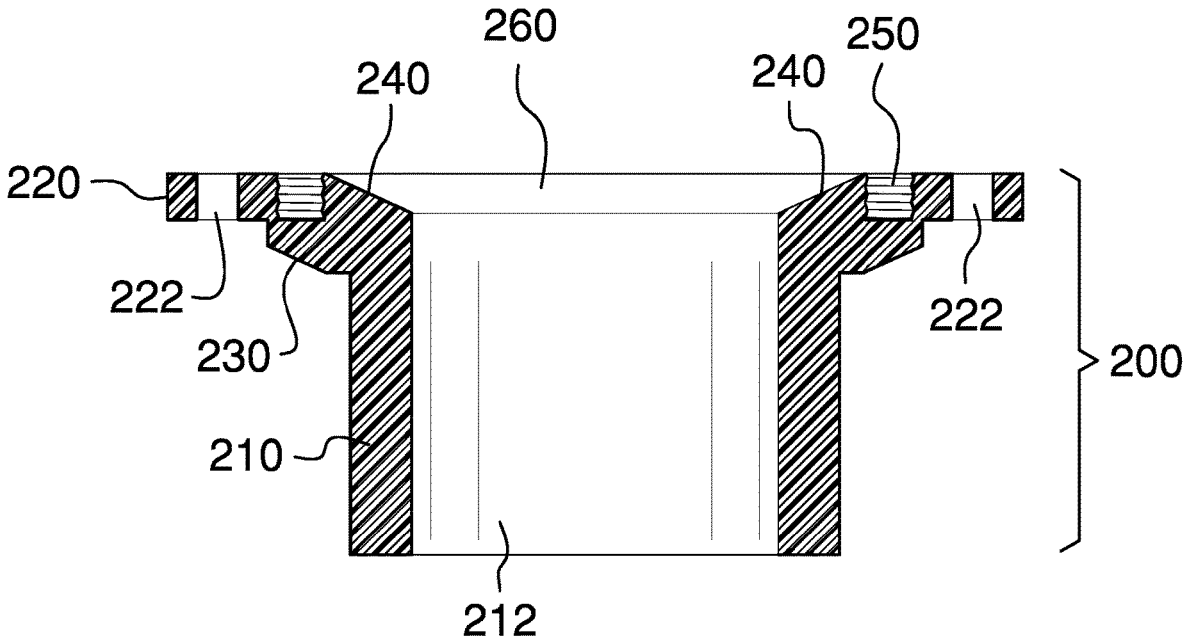
FIG. 4 is a cross-sectional view of an embodiment of the disclosure across 4-4 as shown in FIG. 3.
Figure 5:
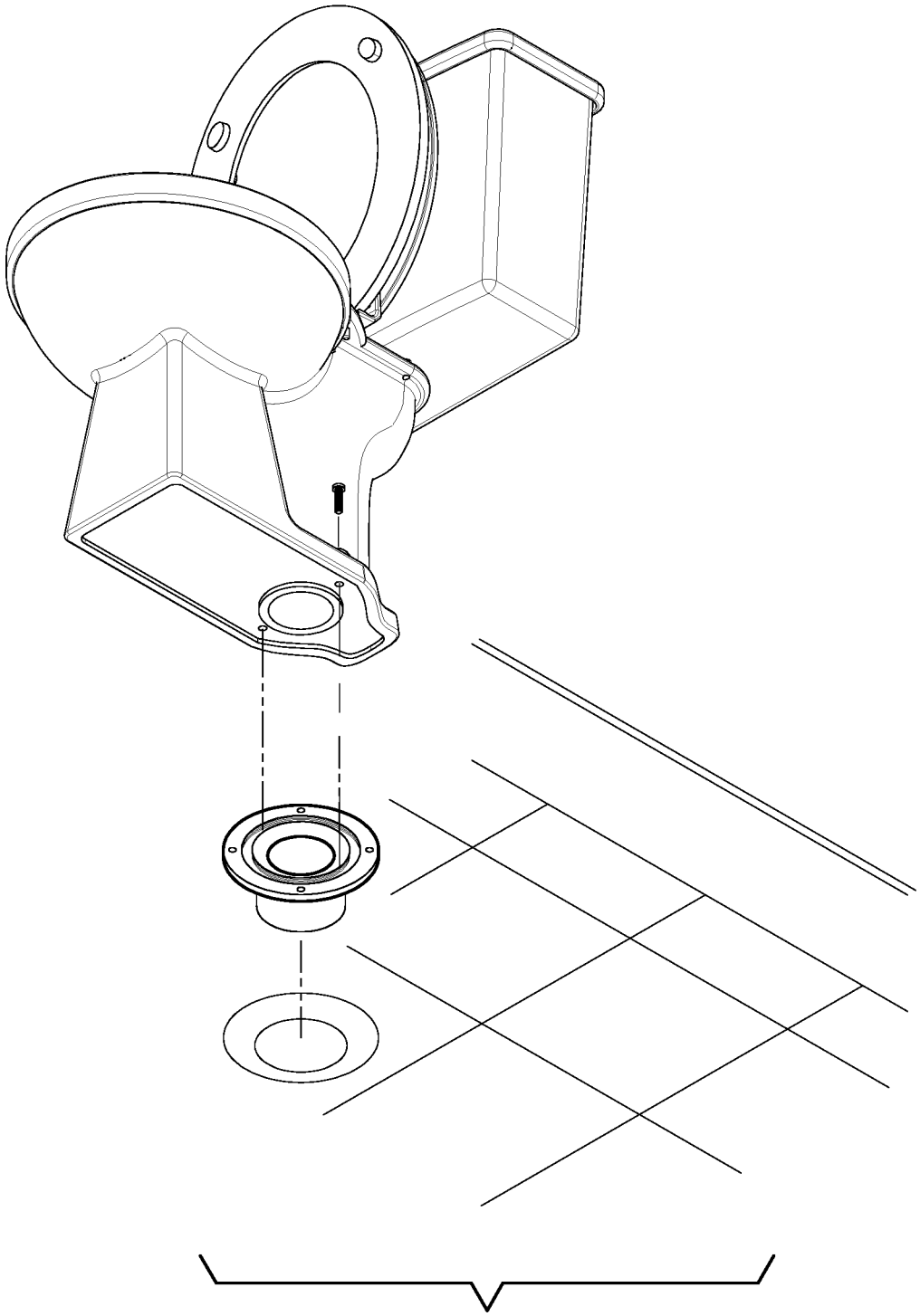
FIG. 5 is an exploded view of an embodiment of the disclosure.

Detailed reference will now be made to a first potential embodiment of the disclosure, which is illustrated in FIGS. 1 through 5.

The modular toilet flange 100 (hereinafter invention) may be a fitting that mounts a toilet 900 to a floor 934 and directs effluent from the toilet 900 to an outflow pipe 930. The invention 100 may comprise a flange body 200 and an inner ring 250. The flange body 200 may couple to the floor 934 and to the outflow pipe 930. The inner ring 250 may be a circular depression in the flange body 200 surrounding an open center 260 of the flange body 200. A pair of bolts 270 extending downward through the toilet 900 may couple to the inner ring 250 by engaging the inner ring 250. During installation, the toilet 900 may be operable to rotate above the flange body 200 to any angle and still engage the inner ring 250, thus eliminating a need for a specific alignment of the toilet 900 with mounting bolts extending upwards from a flange.

The flange body 200 comprises a neck 210 and an outer ring 220. The flange body 200 may be a T-shaped fitting with the neck 210 extending downwards at the center of the flange body 200 and the outer ring 220 comprising a flat top on the flange body 200. The neck 210 may be a vertically-oriented pipe comprising a hollow center 212. The bottom of the neck 210 may detachably couple to the outflow pipe 930. In some embodiments, the coupling between the neck 210 and the outflow pipe 930 may utilize a rubber gasket to form a watertight connection. The top of the neck 210 may couple to the outer ring 220. In some embodiments, the outer ring 220 may comprise a beveled upper inside edge 240 to direct the effluent into the neck 210.

The outer ring 220 may be a horizontally-oriented, annular lip located at the top of the flange body 200. The outer ring 220 may comprise a plurality of mounting apertures 222. The outer ring 220 may be adapted to be retained to the floor 934 when a plurality of screws are driven into the floor 934 after passing through the plurality of mounting apertures 222.

In some embodiments, the flange body 200 may comprise a collar 230. The collar 230 may be a widening of the flange body 200 at the junction of the neck 210 and the outer ring 220. The collar 230 may rest on the floor 934 such that the weight of the toilet 900 is transferred the floor 934 instead of pressing down on the outflow pipe 930.

The inner ring 250 may be a circular depression in the flange body 200 surrounding the open center 260 of the flange body 200. The inner ring 250 may comprise a threaded inside surface 252 and a threaded outside surface 254 on opposing sides of the inner ring 250. The threaded inside surface 252 and the threaded outside surface 254 may complement each other in that the threading on the threaded inside surface 252 and the threaded outside surface 254 may comprise identical thread form, pitch, size, and thread depth. The threading on the threaded inside surface 252 and the threaded outside surface 254 may complement the threading of an individual bolt 272 selected from the pair of bolts 270. The threading on the threaded inside surface 252 and the threaded outside surface 254 may comprise identical angles oriented in opposite directions relative to the top surface of the flange body 200. The threading on the threaded inside surface 252 and the threaded outside surface 254 may be positioned such that the individual bolt 272 may screw into the inner ring 250 by engaging the threaded inside surface 252 on one side of the individual bolt 272 and by engaging the threaded outside surface 254 on the opposite side of the individual bolt 272.

The toilet 900 may be coupled to the flange body 200 by passing the pair of bolts 270 through a pair of bolt apertures 902 located on the base of the toilet 900 and into the inner ring 250. The toilet 900 may be rotated around a vertical axis 290 extending upwards from the center of the flange body 200 to any angle required for the installation while the pair of bolts 270 before tightening the pair of bolts 270 against the base of the toilet 900. As the pair of bolts 270 are tightened, the pair of bolts 270 may screw downward into the inner ring 250 thus pulling the heads of the pair of bolts 270 against the base of the toilet 900 and preventing the toilet 900 from moving. As the pair of bolts 270 are screwed into the inner ring 250 after passing through the base of the toilet 900, the pair of bolts 270 may be located on opposite sides of the inner ring 250.

In use, the flange body 200 may be placed over the outflow pipe 930. The neck 210 and the outflow pipe 930 may be coupled by placing the bottom of the neck 210 into the outflow pipe 930. In some embodiments, the rubber gasket may be used to seal this connection. The flange body 200 may be fastened to the floor 934 by passing a plurality of screws through the plurality of mounting apertures 222 in the outer ring 220 and screwing the plurality of screws into the floor 934. A wax ring may be placed onto the invention 100. The toilet 900 may be lowered onto the invention 100 such that the trap of the toilet 900 is aligned with the open center 260 of the flange body 200. The toilet 900 may be rotated into a desired position. As a non-limiting example, the toilet 900 may be rotated to square the toilet tank with a wall 950. The pair of bolts 270 may be inserted through the pair of bolt apertures 902 located on the base of the toilet 900 and the pair of bolts 270 may be threaded into the inner ring 250. The pair of bolts 270 and tightened to retain the toilet 900 in place.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used herein, "complement" or "complementary" may refer to a compatibility between two threaded parts such that the gender, handedness, form, angle, pitch, diameter, and thread depth of both threads are compatible for the parts to mate by screwing the threads together.

As used herein, the words "couple", "couples", "coupled" or "coupling", may refer to connecting, either directly or indirectly, and does not necessarily imply a mechanical connection.

As used herein, the word "desired" may refer to a specific value or action within a range of supported values or action. A "desired" value or action may indicate that a range of values or actions is enabled by the invention and that a user of the invention may select a specific value or action within the supported range of values or action based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, a "gasket" may be an elastomeric material that is placed between a first surface and a second surface for the purpose of creating a liquid or gas impermeable seal between the first surface and the second surface or preventing the first surface from damaging the second surface (or vice versa).

As used in this disclosure, "horizontal" may be a directional term that refers to a direction that is perpendicular to the local force of gravity. Unless specifically noted in this disclosure, the horizontal direction is always perpendicular to the vertical direction.

As used herein, the word "pitch" may refer to the center-to-center spacing between a plurality of objects or holes.

As used in this disclosure, "vertical" may refer to a direction that is parallel to the local force of gravity. Unless specifically noted in this disclosure, the vertical direction is always perpendicular to horizontal.

As used herein, the word "watertight" may refer to a barrier that is impermeable to water.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A modular toilet flange comprising:

a flange body and an inner ring;

wherein the modular toilet flange is a fitting that mounts a toilet to a floor and directs effluent from the toilet to an outflow pipe;

wherein the flange body couples to the floor and to the outflow pipe;

wherein the inner ring is a circular depression in the flange body surrounding an open center of the flange body;

wherein a pair of bolts extending downward through the toilet couples to the inner ring by engaging the inner ring;

wherein during installation, the toilet is operable to rotate above the flange body to any angle and still engage the inner ring.

2. The modular toilet flange according to claim 1 wherein the flange body comprises a neck and an outer ring;

wherein the flange body is a T-shaped fitting with the neck extending downwards at the center of the flange body and the outer ring comprising a flat top on the flange body.

3. The modular toilet flange according to claim 2 wherein the neck is a vertically-oriented pipe comprising a hollow center.

4. The modular toilet flange according to claim 3 wherein the bottom of the neck detachably couples to the outflow pipe.

5. The modular toilet flange according to claim 4 wherein the top of the neck couples to the outer ring.

6. The modular toilet flange according to claim 5 wherein the outer ring comprises a beveled upper inside edge to direct the effluent into the neck.

7. The modular toilet flange according to claim 5 wherein the outer ring is a horizontally-oriented, annular lip located at the top of the flange body.

8. The modular toilet flange according to claim 7 wherein the outer ring comprises a plurality of mounting apertures;

wherein the outer ring is adapted to be retained to the floor when a plurality of screws are driven into the floor after passing through the plurality of mounting apertures.

9. The modular toilet flange according to claim 8 wherein the flange body comprises a collar;

wherein the collar is a widening of the flange body at the junction of the neck and the outer ring.

10. The modular toilet flange according to claim 9 wherein the collar rests on the floor such that the weight of the toilet is transferred the floor instead of pressing down on the outflow pipe.

11. The modular toilet flange according to claim 10 wherein the inner ring comprises a threaded inside surface and a threaded outside surface on opposing sides of the inner ring.

12. The modular toilet flange according to claim 11 wherein the threaded inside surface and the threaded outside surface complement each other in that the threading on the threaded inside surface and the threaded outside surface comprise identical thread form, pitch, size, and thread depth.

13. The modular toilet flange according to claim 12 wherein the threading on the threaded inside surface and the threaded outside surface complement the threading of an individual bolt selected from the pair of bolts.

14. The modular toilet flange according to claim 13 wherein the threading on the threaded inside surface and the threaded outside surface comprise identical angles oriented in opposite directions relative to the top surface of the flange body.

15. The modular toilet flange according to claim 14 wherein the threading on the threaded inside surface and the threaded outside surface is positioned such that the individual bolt screws into the inner ring by engaging the threaded inside surface on one side of the individual bolt and by engaging the threaded outside surface on the opposite side of the individual bolt.

16. The modular toilet flange according to claim 15 wherein the toilet is coupled to the flange body by passing the pair of bolts through a pair of bolt apertures located on the base of the toilet and into the inner ring.

17. The modular toilet flange according to claim 16 wherein the toilet is rotated around a vertical axis extending upwards from the center of the flange body to any angle while the pair of bolts before tightening the pair of bolts against the base of the toilet;

wherein as the pair of bolts are tightened, the pair of bolts screw downward into the inner ring thus pulling the heads of the pair of bolts against the base of the toilet and preventing the toilet from moving.

18. The modular toilet flange according to claim 17 wherein as the pair of bolts are screwed into the inner ring after passing through the base of the toilet, the pair of bolts is located on opposite sides of the inner ring.

* * * * *